US009493893B2

(12) United States Patent
Selter

(10) Patent No.: US 9,493,893 B2
(45) Date of Patent: Nov. 15, 2016

(54) KNITTING NEEDLE SET

(71) Applicant: Gustav Selter GmbH & Co KG, Altena (DE)

(72) Inventor: Thomas Selter, Altena (DE)

(73) Assignee: GUSTAV SELTER GMBH & CO KG, Altena (DE)

( * ) Notice: Subject to any disclaimer, the term of this patent is extended or adjusted under 35 U.S.C. 154(b) by 104 days.

(21) Appl. No.: 14/227,970

(22) Filed: Mar. 27, 2014

(65) Prior Publication Data

US 2015/0240398 A1 Aug. 27, 2015

(30) Foreign Application Priority Data

Feb. 26, 2014 (DE) ..... 20 2014 001 683 U

(51) Int. Cl.
*D04B 3/02* (2006.01)

(52) U.S. Cl.
CPC ..... *D04B 3/02* (2013.01); *Y10T 29/49826* (2015.01)

(58) Field of Classification Search
CPC ..... D04B 3/02
USPC ..... 66/117, 118
See application file for complete search history.

(56) References Cited

U.S. PATENT DOCUMENTS

| | | | | | |
|---|---|---|---|---|---|
| 1,183,250 | A * | 5/1916 | Smith | D04B 17/04 | 66/117 |
| 1,351,016 | A * | 8/1920 | Bell | 66/117 | |
| 1,537,762 | A * | 5/1925 | Genese | D04B 3/02 | 66/117 |
| 1,960,133 | A * | 5/1934 | Aivazian | D04B 3/00 | 66/117 |
| 2,093,631 | A * | 9/1937 | Burnham | D04B 3/02 | 66/117 |
| 2,102,600 | A * | 12/1937 | Miller | D04B 3/02 | 66/117 |
| 2,133,431 | A * | 10/1938 | Craft | D04B 17/04 | 66/117 |
| 2,245,893 | A * | 6/1941 | Armitage | D04B 17/04 | 66/117 |
| 2,507,174 | A * | 5/1950 | Phillips | D04B 3/02 | 66/118 |
| 2,578,117 | A * | 12/1951 | Winslow | D04B 17/04 | 66/117 |
| 2,748,582 | A * | 6/1956 | Hadler | D04B 17/04 | 66/117 |
| 3,229,484 | A * | 1/1966 | Standart | D04D 9/02 | 223/102 |
| 3,280,595 | A * | 10/1966 | Linstead | D04B 3/00 | 66/117 |
| 3,678,712 | A * | 7/1972 | Singleton | D05B 85/00 | 223/102 |
| 4,007,610 | A * | 2/1977 | Linstead | D04B 3/02 | 66/117 |
| 4,501,133 | A * | 2/1985 | Kretzschmar | D04B 3/00 | 66/117 |
| 4,846,351 | A * | 7/1989 | Gardiner | D04B 3/00 | 206/459.5 |
| 7,669,441 | B2 * | 3/2010 | Zeleny | D04B 3/02 | 66/117 |
| 8,464,559 | B2 * | 6/2013 | West | D04B 3/02 | 66/117 |
| D733,417 | S * | 7/2015 | Hawley | D3/18 | |
| 2014/0047868 | A1 * | 2/2014 | Kellogg | D04B 17/04 | 66/117 |
| 2014/0202215 | A1 * | 7/2014 | Zorbach | D04B 3/02 | 66/117 |
| 2015/0143854 | A1 * | 5/2015 | Defay | D04B 3/02 | 66/117 |
| 2015/0240398 | A1 * | 8/2015 | Selter | D04B 3/02 | 66/117 |

FOREIGN PATENT DOCUMENTS

| | | | | |
|---|---|---|---|---|
| GB | 2181751 A * | 4/1987 | D04B 3/02 | |
| GB | 2231589 A * | 11/1990 | D04B 3/02 | |
| JP | 63042946 A * | 2/1988 | | |
| WO | 95/12699 A1 | 5/1995 | | |

* cited by examiner

*Primary Examiner* — Danny Worrell
(74) *Attorney, Agent, or Firm* — Seed IP Law Group LLP

(57) ABSTRACT

The present disclosure is directed to a needle set that includes a plurality of knitting needles configured to knit tubular knitted items, each knitting needle including: a first needle point, a second needle point, and a shank extending between the first and second needle points, the first needle point being a different needle shape from the second needle point.

10 Claims, 2 Drawing Sheets

KNITTING NEEDLE SET

BACKGROUND

1. Technical Field

The present invention concerns a needle set comprising five knitting needles of the same size and length for knitting tubular knitted items like socks or arms of pullovers. The present invention also concerns a corresponding knitting needle, and the production of such knitting needles.

2. Description of the Related Art

Often needle sets or knitting needle sets are particular knitting needle arrangements. They are generally known and are used in particular when for example socks are to be knitted without a seam in the leg region. The quality of the knitted item to be produced in that way also depends on the quality but also the nature of the knitting needles used. Particular attention can be directed here to the needle points.

Particularly pointed needle points are readily used for knitting particularly rapidly with fine wool and complicated patterns. In that case, the pointed needle points can engage particularly well and particularly quickly under the stitches and draw the knitting wool through the stitch in order to form the next stitch.

If knitting is not to be effected particularly quickly or if coarser patterns or thick wool is to be used, it can be more pleasing to use a knitting needle point which is less pointed. Naturally much also depends on the feel and the habits of the person doing the knitting. If however as a result the blunter point also becomes shorter, a new and therefore freshly knitted stitch passes more quickly on to the cylindrical shank portion of the knitting needle. That can make the knitting process more pleasant if fewer or no stitch at all is on the point region of the needle in the knitting process and can possibly also improve the quality of the knitted item, more specifically in particular the uniformity of the knitted item. The knitting wool used can also play an important part. Depending on the respective material and thickness and also the color or other nature of the wool the wool can slide or stick on the knitting needle. That can also have influence on the appropriate form of the point of the knitting needle or other properties of the knitting needle.

Accordingly it would be desirable to use a suitable knitting needle for each situation, that is to say each knitting person, the wool used, the desired knitting speed and other influencing factors.

Therefore a needle set comprising five identical knitting needles immediately encounters the problem that five different knitting needles are identically required for each change. That is a disadvantage not only in terms of providing a correspondingly large number of knitting needles but it can also be a nuisance in particular when travelling because a correspondingly large number of needle sets have to be transported and also kept away from each other.

BRIEF SUMMARY

Therefore the object of the present invention is to address at least one of the above-mentioned problems. In particular the invention seeks to provide a solution for fulfilling various knitting requirements at the lowest possible level of complication and expenditure. In that respect the invention seeks to provide that little complication is to arise from the point of view of the user, with a solution which at the same time is as inexpensive as possible. The invention seeks to provide at least an alternative solution in relation to previous solutions.

According to the invention there is proposed a needle set as described below. Such a needle set comprises five identical knitting needles and each knitting needle comprises a first and a second needle point which are connected by way of a shank. The first needle point is of a different point shape from the second needle point. In that way the user can easily choose between two needle points. It is only necessary for the needles to be turned round depending on the respective requirement and/or situation of use to select the desired needle point.

BRIEF DESCRIPTION OF THE SEVERAL VIEWS OF THE DRAWINGS

The invention is described in greater detail by way of example hereinafter by means of embodiments with reference to the accompanying Figures.

DETAILED DESCRIPTION

Figure 1:
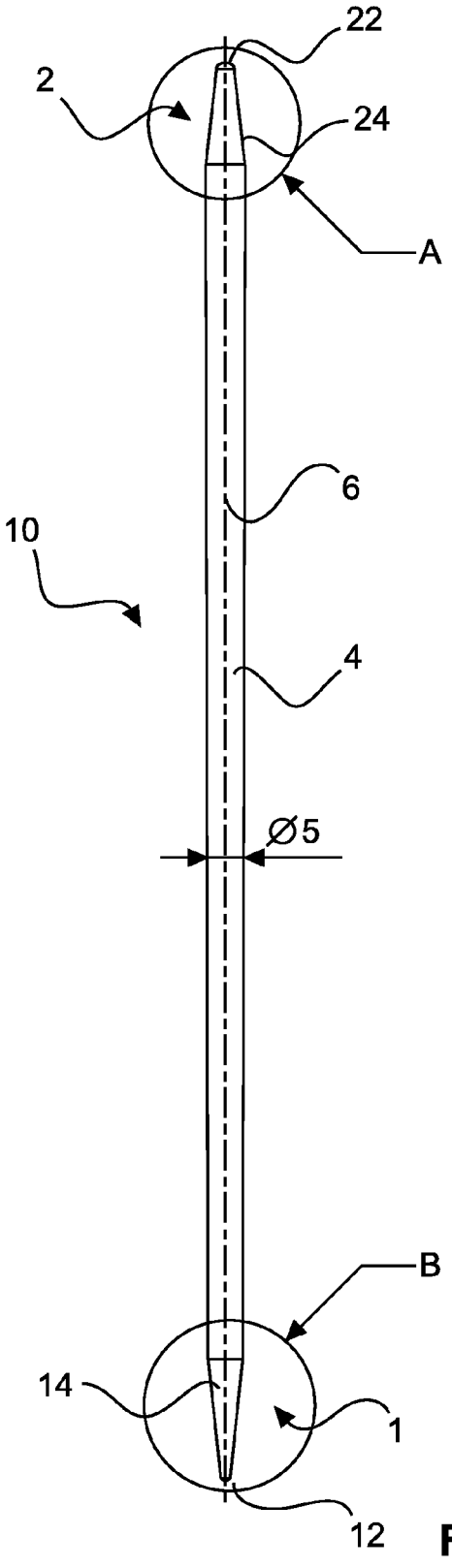
FIG. 1 shows a side view of a knitting needle of a needle set.

The solution is surprisingly and amazingly simple. More specifically in that respect such a solution was in no way to be foreseen. It is to be noted in that respect that when knitting with such a needle set the knitted item rests in a middle production condition with the current surrounding row of stitches on four of the five needles. The knitted item, that is to say for example a sock, is therefore on each one of the four knitting needles with a respective quarter of the stitches which are currently just being knitted. The fifth knitting needle is free and is then used for continuing with the knitting, namely with one of the four needles on which the stitches are carried. If now for example it is assumed that basically knitting is effected from left to right—the same principle applies basically when knitting from right to left—knitting is carried over from one of the four knitting needles occupied with stitches, for example the fourth knitting needle, towards the right and on to the fifth knitting needle. With that fifth knitting needle therefore, one stitch after the other is lifted off the left-hand fourth knitting needle and in that case naturally the respective wool is knitted therewith, by a respective new stitch being produced in that case with the fresh wool. Those fresh stitches are then basically shifted from left to right on to the fifth knitting needle. In the case of that fifth knitting needle the point with which knitting is actively being effected, that is to say the stitches are being lifted off the fourth knitting needle, is arranged at the left. The fresh stitches therefore shift from the left-hand point which was more specifically selected for knitting, to the right-hand point. The right-hand point is different from the left-hand point and more specifically it is in that case the non-desired point.

By virtue of that process the fourth needle now becomes free and can then be used to continue the knitting together with the next knitting needle, for example the third needle. Then therefore, stated in simplified terms, with the fourth knitting needle, the stitches are progressively lifted off the third knitting needle and knitting is continued therewith. In this case also the stitches are moved from left to right on to what is now the fourth knitting needle. Once again the desired needle point is at the left. Knitting is further continued in the same way, more specifically knitting is effected with the third knitting needle which has become free, together with the second knitting needle, until that becomes free. Knitting is effected with the second needle, with the first needle, until that becomes free and when then the first has become free, that can be used together with the fifth needle for the knitting process.

At any event, in that sense, in regard to each of the five knitting needles the desired point is at the left, in relation to a peripheral or circulating direction. It could also be said that all desired points face in the counter-clockwise direction, or conversely knitting would be effected from right to left.

If now knitting is continued with the first knitting needle which has become free and the fifth knitting needle, in accordance with the example used hereinbefore, naturally the desired needle point is again used in relation to the first knitting needle. The fifth knitting needle however has its point which is desired at that time, at the left. In other words, the point which has not been selected is at the right and knitting can be effected with the one knitting needle, in the example being at the right, with the desired point, but with the left-hand knitting needle which is the current needle in that respect knitting has to be effected with the point that was not the desired one.

It was however realized that in that case the only crucial consideration is the point which is respectively lifting off the stitch and knitting the fresh stitch with the wool. In the example discussed hereinbefore therefore that would be the right-hand knitting needle. The other knitting needle only needs to prepare the respective stitch.

For that reason it is anything but self-evident to provide a knitting needle of a needle set for knitting socks with different points, for that inevitably means that knitting has to be effected in each case with different points. It has been found however that this is in no way a nuisance and on the contrary is decisive insofar as the desired knitting needle point is selected for the knitting needle which respectively removes the stitches. Now according to the invention, that can be simply effected by the knitting needle being turned so that the desired point is at the front.

Preferably the needle points of a knitting needle differ, that is to say the first and second needle points, in that the first needle point is more pointed than the second needle point. In that way the more pointed needle point can be selected for fast knitting. If knitting is not to be fast then it is possible to use the blunter needle point.

Preferably each knitting needle is formed in one piece, in particular being made from a material, for example from a wire portion of a metal wire or tube produced by sawing or cutting with suitably produced, for example ground, needle points. Particularly after suitably subsequent polishing and/or coating that gives a single smooth surface for the entire knitting needle. In spite of that overall unitary seamless surface it is possible to make a choice between two needle points.

Preferably each knitting needle is made from aluminum or an aluminum alloy and possibly carries a coating which is highly suitable for guiding wool or other stitches of the knitting yarn.

Preferably the length of each knitting needle is about 20 cm. That is an advantageous length for knitting in particular socks and it also affords sufficient length for being able to still provide the two differing needle points. A slight deviation from that dimension, also depending on the respective knitted item to be produced, is also advantageous. Thus each knitting needle can be of a length in region of between 18 and 22 cm or even in a region of between 15 and 25 cm. The stated lengths are advantageous in particular for knitting needles of needle sets.

In addition or alternatively a needle shank diameter of about 5 mm is advantageous depending on the respective wool used. Here the knitting needle can still be agreeably held and at the same time the stitches can be well guided. Slight deviations may be desirable depending on the respective user and the knitting application involved, in particular in the region of between 4 and 6 mm in diameter or even in the region of between 2 and 8 mm in diameter.

Preferably the first and second needle points of each knitting needle of that needle set has a rounded point end and a truncated cone connecting the point end to the shank. The rounded point end can be in particular in the form of a hemisphere. The truncated cone provides an advantageous transition from the shank to that rounded point end and the truncated cone in that case forms the major part of the respective point. The description of the truncated cone which is based on the known mathematical description of that geometrical object is intended in that respect also only to describe the geometrical shape of the point. The reference to the truncated cone is not to be interpreted as meaning that this is or was an independent element or also only an element which was independent in the course of manufacture. The description based on the truncated cone also refers to the case of an integral configuration of the entire knitting needle.

That truncated cone thus has a base surface facing towards the shank with a base radius R and a smaller top surface which faces towards the point end, with a top radius r. The spacing between the base surface and the top surface is the height h of the truncated cone and an angle between the lateral surface and the cone line is the cone angle cp. The cone angle is therefore the angle between the center line of the knitting needle and a line which in a side view or also a sectional view coincides portion-wise with the contour of the cone peripheral or lateral surface. The terms are also discussed hereinafter with reference to a Figure relating to the truncated cone.

According to an embodiment it is now proposed that the base radii of the first and second points are of the same size. The top radii of the first and second points however are to be different, namely in such a way that the top radius of the first point which is therefore preferably more pointed than the second point is smaller than the top radius of the second point.

In addition or alternatively the height of the truncated cone of the first point is greater than the height of the truncated cone of the second point. In addition or alternatively it is proposed that the cone angle of the first point is identical to the cone angle of the second point. That then means that the first point is admittedly more pointed, in such a way that its point end is smaller than in the case of the second point, but it involves the same inclination as the second point. In other words the first point is basically only longer than the second point and in that respect converges over its longer length to a smaller point end.

Particularly preferably the cone angle is of a value of about 6°. In a side view therefore the two sides of the truncated cone are at an angle of 12° to each other. That can provide for good stitch guidance and such an angle also permits use both for a pointed and less pointed point and for a short and a long point.

The use of the same angles for differing points means that a knitting needle with differing points can be produced in a simple fashion.

In that respect slight deviations may still be appropriate, in particular if the cone angle in that respect ranges in a range of between 5° and 7°. A range of between 10 and 14° for the position of mutually opposite contours of the point is therefore proposed.

For the top radius of the first more pointed point a value of about 0.65 mm is proposed, that is to say a diameter of about 1.3 mm. That can permit advantageously fast knitting without the point being of an injury-causing pointed configuration. A deviating range in respect of that top radius of the first point can be in the region of between 0.5 and about 0.8 mm.

In addition or alternatively a top radius for the second point of about 1 mm if proposed, that is to say a diameter of about 2 mm. In that way the second, that is to say shorter or blunter, point is significantly shorter or blunter than the first point. Slight deviations therefrom may also be advantageous, in particular if they are in a range of between 0.8 mm and about 1.15 mm for the top radius of the second point.

According to the invention there is also provided a knitting needle which in particular can be assembled together with the four other identical knitting needles to afford a needle set. That has the properties of at least one embodiment of the knitting needles which were described hereinbefore in connection with the needle set.

In addition there is proposed a process for producing such a knitting needle or a knitting needle in accordance with one of the described embodiments. The process includes the steps of cutting an elongate metal portion to the desired length of the knitting needle to be produced, and providing two different knitting needle points on said metal portion. The metal portion can be for example a wire or tube from which the desired length is removed, or it is also possible for example to consider an extrusion process or the like.

A surface treatment, in particular refining finishing, can then be implemented so that the surface has properties suitable for knitting.

Preferably production of a knitting needle for a needle set is effected in such a way that firstly an elongate metal portion is straightened. Then, in which case this can be combined in a common working process, the metal portion for each knitting needle is cut to the desired length of the knitting needle to be produced. The two different points are then produced. In the next step the points and the knitting needle are polished overall. As a result the knitting needle overall, in particular at the transitions to the needle points, acquires a smooth surface without sharp edges or projections. Finishing refining of the polished knitting needle is further effected. That finishing procedure can be effected for example by anodization or eloxation. The knitting needle is then waxed as a further treatment of the surface thereof. Printing on the knitting needle then concludes its production procedure. For production of a needle set in particular five knitting needles of the same kind and length are produced in the described manner and finally packed together to form a needle set and can then be passed to the point of sale.

The knitting needle 10 shown in FIG. 1 has a first point 1 and a second point 2 as well as a shank 4 connecting those two points 1 and 2. The first point 1 can be subdivided into two portions, namely a point end 12 and a truncated cone 14. Similarly the second point 2 also has a point end 22 and a truncated cone 24. The illustrated knitting needle 10, in relation to which a longitudinal axis 6 is also shown as illustration in the Figures, is made from a single piece. The example shows a diameter of 5 mm for the shank 4.

It will be seen that the first point 1 is longer than the second point 2 and in that case converges to a smaller point end 12 than the second point 2. The first point 1 is thus also more pointed than the second point 2.

Figure 3:
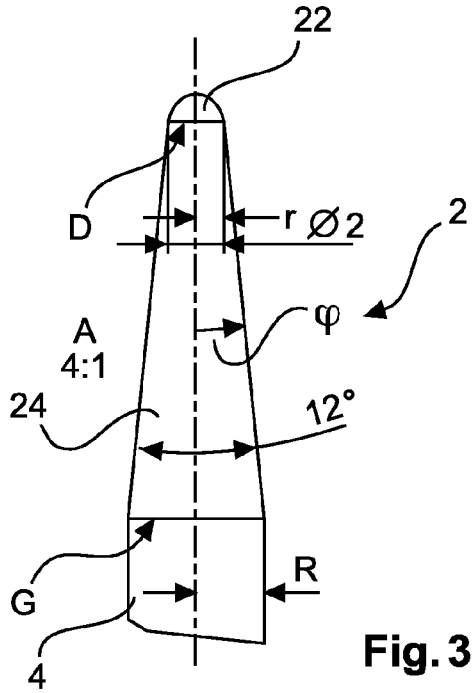
FIG. 3 shows a second point of the knitting needle of FIG. 1 as indicated by portion A.
Figure 2:
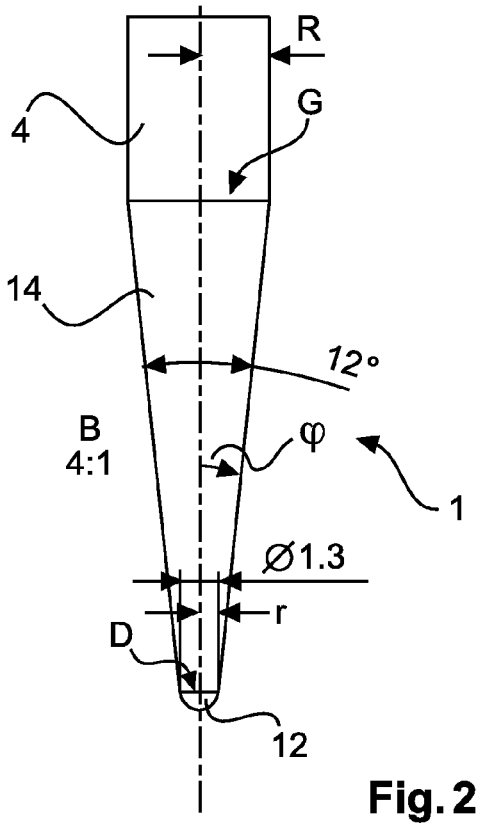
FIG. 2 shows a first point of the knitting needle of FIG. 1 as indicated by portion B.

FIGS. 2 and 3 show an enlarged view of the first and second points 1, 2 respectively. It will be seen therefrom that the two point ends 12 and 22 respectively are in the form of hemispheres. The first point end 12 is markedly smaller, with a diameter by way of example of 1.3 mm, than the second point end 22 involving a diameter of 2 mm. Both points 1 and 2 however have the same cone angle $\phi$, more specifically in the illustrated example 6°. This means that both points 1 and 2 converge at the same angle of 12° to their point end 12 and 22 respectively.

The major part of the first and second points 1, 2, more specifically the truncated cone 14 and 24, can also be defined on the basis of the radii R of the base surface and r of the top surface, in the sense of the usual definition of a truncated cone. Accordingly the first and second points 1, 2 are of the same base radius R, namely half the shank diameter, but involve a different top radius r, more specially in the illustrated example 0.65 mm for the first point 1 and 1 mm for the second point 2.

Figure 4:
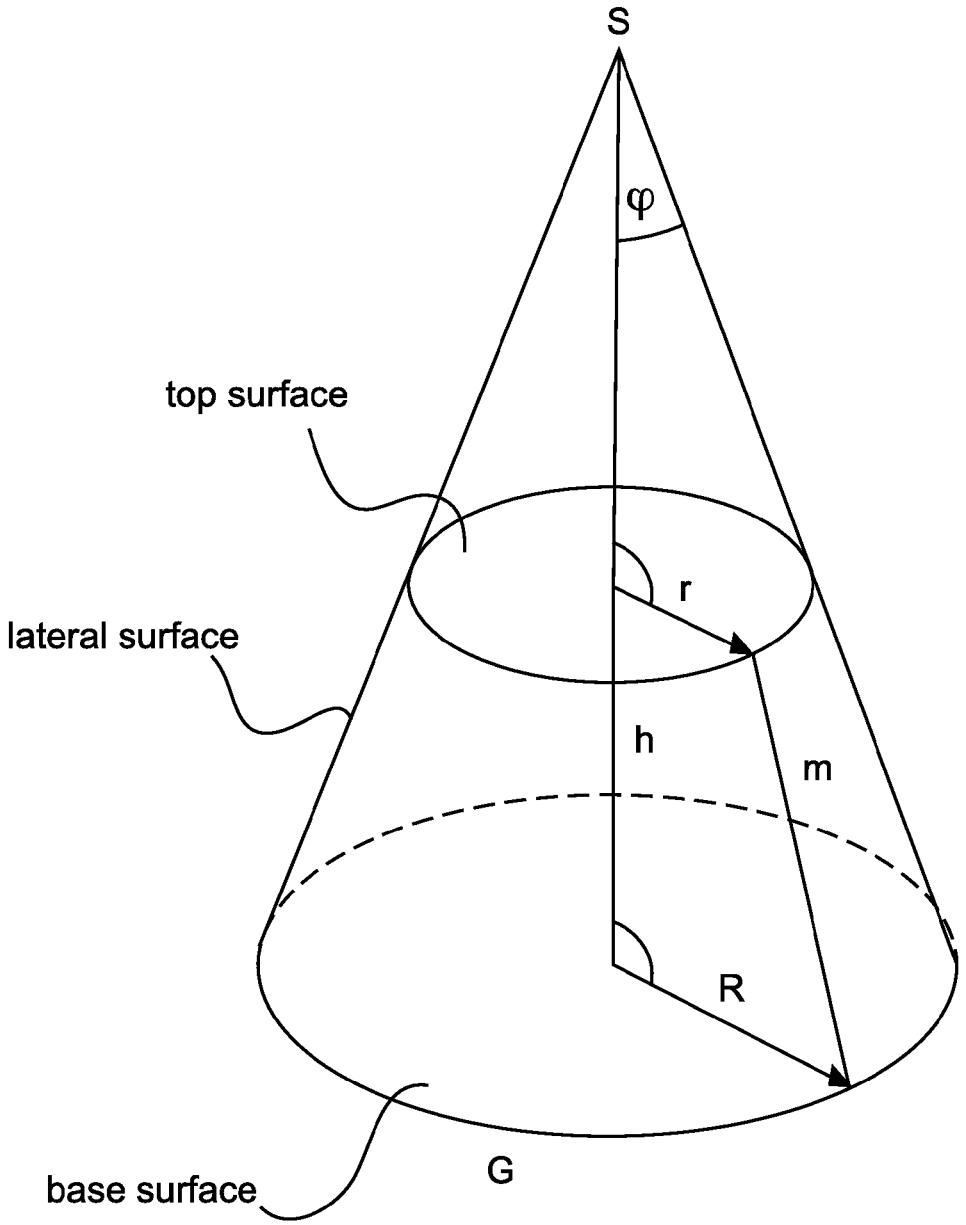
FIG. 4 shows a truncated cone for illustration and terminology definition.

FIG. 4 shows a truncated cone in the form of a geometrical shape only to illustrate the terminology involved. Shown therein are a base surface G, a top surface D and a cone angle cp. The base surface G is of a radius R and the top surface D is of a radius r which are referred to here as the base radius R and the top radius r respectively. The spacing between the base surface G and the top surface D is the height h or the truncated cone height h.

Accordingly the base surface G is that which, as shown in FIG. 2 and FIG. 3 respectively faces from the truncated cone 14 and 24 respectively towards the shank 4. Accordingly the top surface D faces from the truncated cone 14 or 24 to the point end 12 and 22 respectively. This also serves only to explain the geometries involves. In actual fact however the base surface G and the top surface D are not actually present by virtue of the knitting needle 10 being of a one-piece configuration.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A needle set, comprising:

a plurality of knitting needles configured to knit tubular knitted items, each knitting needle including:

a first needle point having a first truncated cone and a first rounded tip, the first truncated cone having a first radius at a first end and a second radius at a second end, the second radius being smaller than the first radius, the second end being adjacent to the first rounded tip, the first truncated cone has a first distance from the first end to the second end;

a second needle point having a second truncated cone and a second rounded tip, the second truncated cone having a third radius at a first end and a fourth radius at a second end, the fourth radius being smaller than the third radius, the second end being adjacent to the second rounded tip, the third radius being substantially the same as the first radius, the fourth radius being smaller than the second radius, the second truncated cone has a second distance from the first end to the second end, and the first distance being smaller than the second distance; and a shank extending between the first ends of the first and second truncated cones, the shank having a consistent diameter from the first end of the first truncated cone to the first end of the second truncated cone, the consistent diameter being substantially the same as the third radius and the first radius.

2. The needle set of claim 1 wherein the plurality of knitting needles includes five identical knitting needles.

3. The needle set of claim 1 wherein each knitting needle includes an aluminum or aluminum alloy.

4. The needle set of claim 3 wherein a coating is over the aluminum or aluminum alloy.

5. The needle set of claim 1 wherein:

each of the truncated cones having cone angles in the range of 5 degrees and 7 degrees from a central axis of the shank;

the fourth radius of the second needle point is in the range of 0.5 mm and about 0.8 mm; and the second radius of the first needle point is in the range of 0.85 mm and about 1.15 mm.

6. The needle set of claim 1 wherein each of the knitting needles has a length between the first rounded tip of the first needle point to the second rounded tip of the second needle tip in the range of 15 cm and 25 cm and the consistent diameter of the shank is in the range of 2 mm and 8 mm.

7. A method, comprising:

forming a knitting needle, the forming of the knitting needle including:

forming a shank by cutting an elongate metal portion, the elongate metal portion having a consistent diameter throughout;

forming a first needle point having a first truncated cone and a first rounded tip, the first truncated cone having a first radius at a first end and a second radius at a second end, the second radius being smaller than the first radius, the second end being adjacent to the first rounded tip, the first truncated cone has a first distance from the first end to the second end;

forming a second needle point having a second truncated cone and a second rounded tip, the second truncated cone having a third radius at a first end and a fourth radius at a second end, the fourth radius being smaller than the third radius, the second end being adjacent to the second rounded tip, the third radius being substantially the same as the first radius, the fourth radius being smaller than the second radius, the second truncated cone has a second distance from the first end to the second end, and the first distance being smaller than the second distance; and coupling the first ends of the first and the second truncated cones of the first and second needle points to the shank, the shank extending between and abutting the first ends of the first and the second truncated cones of the first and the second needle points, the consistent diameter of the shank being substantially the same as the first radius of the first truncated cone and the third radius of the second truncated cone.

8. The method of claim 7 wherein forming the knitting needle includes:

straightening the elongate metal portion prior to the cutting the elongate metal portion;

polishing the first and second needle points;

refining the knitting needle;

waxing the knitting needle after the refining; and printing information on the knitting needle.

9. A device, comprising:

an elongated tubular central support having a consistent diameter throughout, the central support having a first end and a second end;

a first needle tip coupled to the first end of the central support, the first needle tip including:

a first hemispherical end; and a first truncated cone that has a first height between a first end and a second end, the first end having a first radius and the second end having a second radius, the first radius being substantially the same as the consistent diameter, the second radius being smaller than the first radius;

a second needle tip coupled to the second end of the central support, the second needle tip including:

a second hemispherical end; and a second truncated cone that has a second height between a first end and a second end, the first end having a third radius and second end having a fourth radius, the third radius being substantially the same as the consistent diameter, and the fourth radius being smaller than the second radius, the second height being greater than the first height.

10. The device of claim 9 wherein the fourth radius of the second needle point is in the range of 0.5 mm and about 0.8 mm and the second radius of the first needle point is in the range of 0.85 mm and about 1.15 mm.

* * * * *